US006439827B1

(12) United States Patent
Ratcliffe

(10) Patent No.: US 6,439,827 B1
(45) Date of Patent: Aug. 27, 2002

(54) LOAD HANDLING VEHICLE

(75) Inventor: Simon John Ratcliffe, Staffordshire (GB)

(73) Assignee: J C Bamford Excavators Limited, Staffordshire (GB)

( * ) Notice: Subject to any disclaimer, the term of this patent is extended or adjusted under 35 U.S.C. 154(b) by 0 days.

(21) Appl. No.: 09/053,036

(22) Filed: Apr. 1, 1998

(30) Foreign Application Priority Data

| | | |
|---|---|---|
| Jul. 8, 1997 | (GB) | 9714287 |
| Jul. 8, 1997 | (GB) | 9714288 |
| Mar. 23, 1998 | (GB) | 9805985 |
| Mar. 23, 1998 | (GB) | 9805986 |

(51) Int. Cl.[7] ..... E02F 5/00
(52) U.S. Cl. ..... 414/685; 180/291
(58) Field of Search ..... 414/680, 685, 414/686; 180/291, 299, 89.13, 89.14, 89.16, 89.17, 89.18, 242, 243, 417, 305, 306, 307, 308, 89.19

(56) References Cited

U.S. PATENT DOCUMENTS

| | | | | |
|---|---|---|---|---|
| 3,519,156 A | | 7/1970 | Magnuson | |
| 3,688,929 A | | 9/1972 | McIntyre | |
| 4,805,720 A | * | 2/1989 | Clenet | 180/291 X |
| 4,826,474 A | | 5/1989 | Holmes | |
| 5,240,366 A | * | 8/1993 | Bamford | 414/686 |
| 5,478,192 A | | 12/1995 | Bentivoglio | |
| 5,551,826 A | * | 9/1996 | Todd et al. | 414/685 |
| 5,618,156 A | * | 4/1997 | Brown | 414/680 X |

FOREIGN PATENT DOCUMENTS

| | | | |
|---|---|---|---|
| EP | 0692448 A1 | | 1/1996 |
| EP | 0 823 367 A1 | | 2/1998 |
| GB | 2264689 | | 9/1993 |
| GB | 2285796 | * | 7/1995 |
| WO | WO 89/00972 | | 2/1989 |

* cited by examiner

*Primary Examiner*—Donald W. Underwood
(74) *Attorney, Agent, or Firm*—Marshall, Gerstein & Borun

(57) ABSTRACT

A material handling vehicle of the kind specified in which the load carrying means comprises a telescopic boom pivotally mounted to the structure at a rear end region of the boom for up and down swinging movement by said power means in a plane extending forwardly and rearwardly of the vehicle and the boom having a load carrying implement at a forward end region thereof, the front ground engageable wheels being driven by said motor and the rear ground engageable wheels being steerable and the seat, having a region, disposed generally underneath the seat in which the motor is disposed.

17 Claims, 13 Drawing Sheets

LOAD HANDLING VEHICLE

BACKGROUND TO THE INVENTION

This invention relates to a load handling vehicle, hereafter referred to as being of a kind specified, comprising a structure having a load carrying means at a front end of the vehicle, power means to raise the load carrying means, ground engageable propulsion means comprising a pair of front ground engageable wheels disposed one at each side of the vehicle and a pair of rear ground engageable wheels disposed one at each side of the vehicle, an operators seat, and a motor to provide power for said propulsion means to drive at least one of said pairs of wheels and for said power means to raise the load carrying means.

The invention is particularly concerned with a vehicle of the kind specified which is suitable for industrial load handling typically in warehouses or other situations where the vehicle is likely to experience restricted manoeuvring space. Hitherto such a material handling vehicle had a load carrying means which has conventionally comprised an upstanding mast mounted at the front of the vehicle and in front of the driver and a material handling implement which is displaceable up and down the mast. This mast is conventionally extendible to a considerable height over which the material handling implement can be displaced and may also comprise two or more sections which can be raised to increase its overall height and therefore the permissible lift height of the handling material implement.

The material handling implement may comprise a fork having, for example, a pair of tines, or a platform. For convenience both such vehicles will be referred to hereinafter as a lift truck.

In such known lift trucks the forward visibility of the driver when seated in the driver's seat is through the mast structure so that the visibility is necessarily impaired. Also there is the disadvantage that the mast structure even in a collapsed condition stands at a considerable height which can cause loss of access of the vehicle through the doorways and warehouses and the like. A further disadvantage is that multiple and complex lifting mast sections of varying lengths for each lift height may be required for very high lift capabilities with consequential high manufacturing costs. Industrial lift trucks particularly those which are of relatively narrow width, for example less than 1.7 meters, are generally regarded as relatively unsophisticated vehicles and it is therefore necessary that the manufacturing costs of such a vehicle are minimised whilst ensuring that the lift truck is reliable and efficient and will, in use, comply with specified safety standards. This latter requirement being especially true of the stability of the lift truck during load handling.

GB-A-2264689 discloses an attempt to provide a solution to the above mentioned problem but suffers from the disadvantage that it is too large for operating inside a congested warehouse or industrial buildings, where such machines are, typically, intended to be used.

SUMMARY OF THE INVENTION

An object of the invention is therefore to provide a material handling vehicle whereby the above mentioned disadvantages are overcome or are reduced.

According to one aspect of the present invention we provide a material handling vehicle of the kind specified in which the load carrying means comprises a telescopic boom pivotally mounted to the structure at a rear end region of the boom for up and down swinging movement by said power means in a plane extending forwardly and rearwardly of the vehicle and the boom having a load carrying implement at a forward end region thereof, the front ground engageable wheels being driven by said motor and the rear ground engageable wheels being steerable and the seat having a region disposed generally underneath the seat in which the motor is disposed.

The rear ground engageable wheels may be undriven by said motor.

The axis of rotation of the crankshaft of the engine may be offset away from the centre line of the vehicle in a direction which is away from the boom.

The crankshaft may be offset away from the centre line of the vehicle in a direction which is away from the boom, for example, by up to about 100 mm.

This allows the space below the boom to be unobstructed by the engine. Thus, if desired, when lowered, the boom or a component connected to the boom and depending downwardly therefrom may be at least partly alongside the engine.

The boom may be offset, width-wise of the vehicle, substantially to overlie the front and rear wheels at one side of the vehicle and to provide clearance width wise of the truck for the driver's seat to be disposed alongside the boom.

The vehicle preferably has an overall width of less than 1.2 meters.

The operator's seat may be positioned within an operator's compartment.

The ratio of the width of the operator's compartment to the overall width of the vehicle may lie in the range 1:0.5 to 1:0.8.

The engine may be drivingly connected to the front wheels by hydrostatic drive means.

The load carrying implement may be offset widthwise of the vehicle from the boom so that the load carrying implement is disposed in a region which is disposed substantially centrally of the vehicle in a widthwise direction.

The operator's compartment, including the seat, may be pivotally mounted relative to the structure about an axis entering width wise of the vehicle at a position disposed at the front of the compartment so that the compartment and seat may be pivoted upwardly and forwardly to provide access to the engine.

The axis of pivot of the boom may be disposed at a position which is less than 30% of the rear wheel diameter behind the axis of rotation of the rear wheel.

The overall boom length is 95% of the total machine length.

Accordingly, the present invention aims at achieving the stated object by providing a smaller, more compact, machine which may be less that 1.2 meters wide, 2.6 meters long and 2.17 meters high. This is achieved by disposing the engine under the cab and by offsetting the axis of rotation of the crankshaft of the engine away from the centre line of the machine in a direction which is away from the boom, for example by about up to about 100 mm thus, when lowered, allowing the boom or a component connected to the boom, and depending downwardly therefrom to be at least partly alongside the engine. Such a vehicle is relatively narrow and is capable of relatively inexpensive manufacture in combination with efficient load handling and lifting to a relatively great height whilst ensuring that the forward visibility of the truck driver is not unnecessarily impaired by components of the vehicle together with posessing stable load handling characteristics.

DESCRIPTION OF THE PREFERRED EMBODIMENTS

Figure 1:
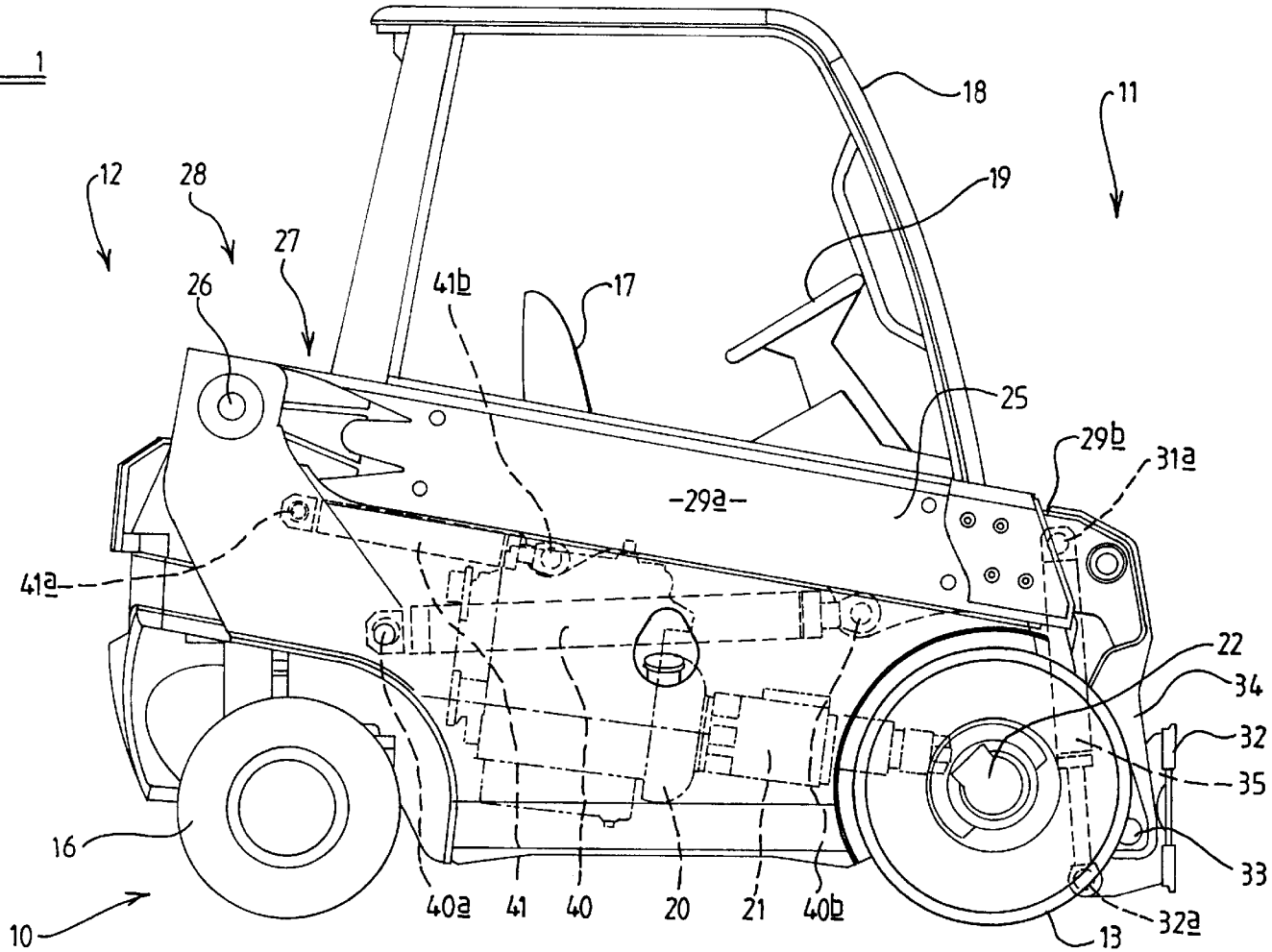
FIG. 1 is a side view of a load handling vehicle embodying the invention.
Figure 2:
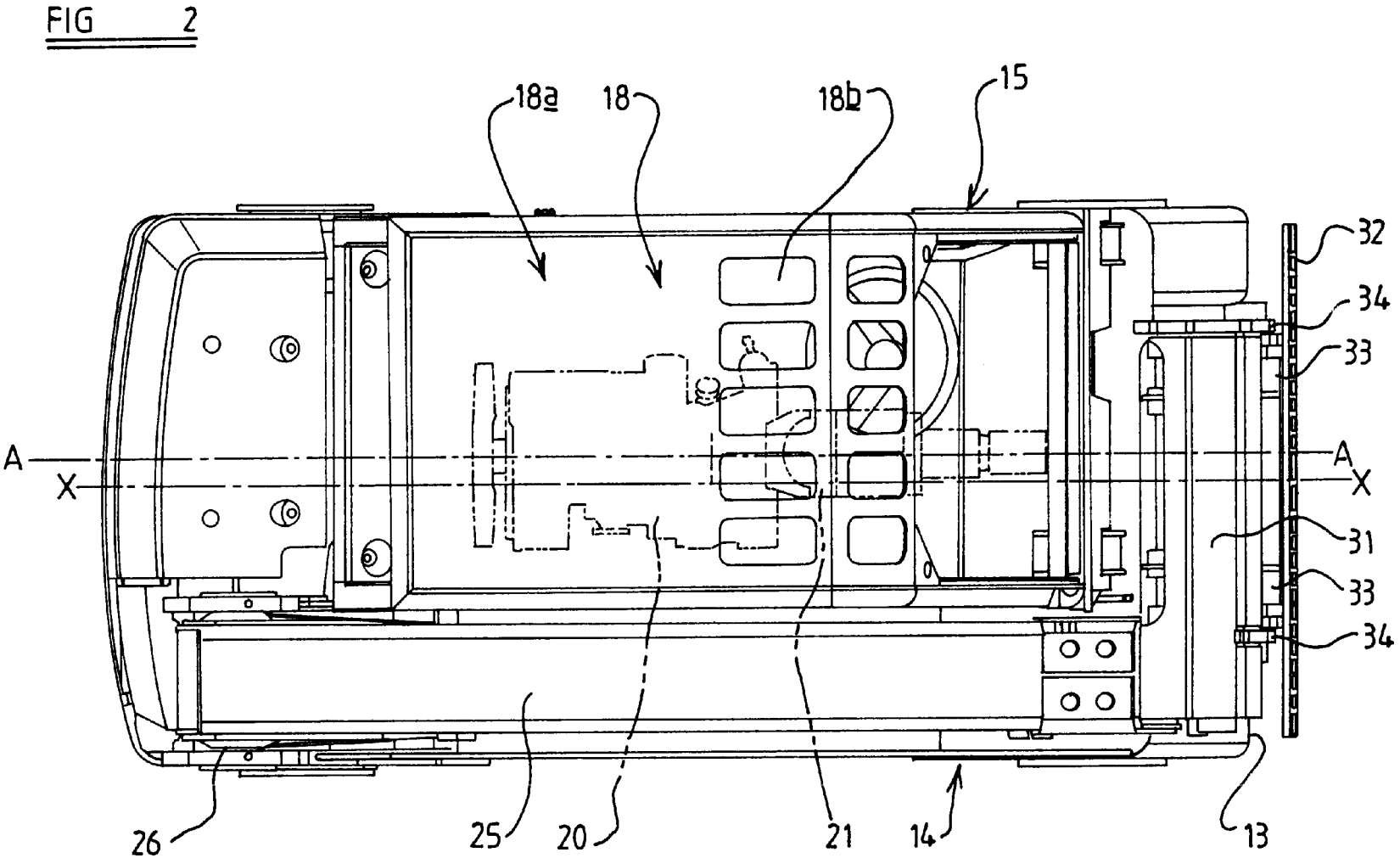
FIG. 2 is a plan view of the vehicle of FIG. 1.
Figure 3:
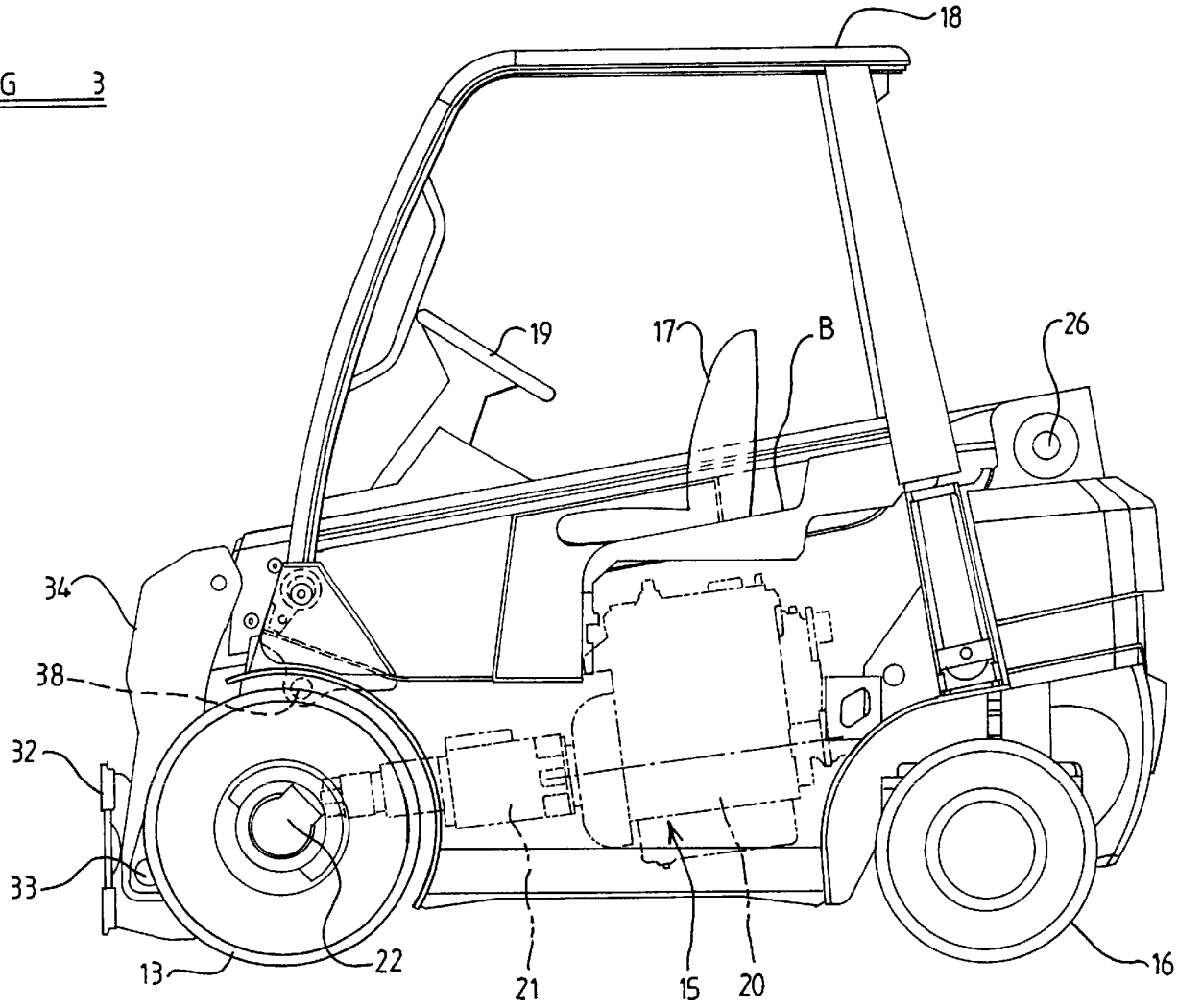
FIG. 3 is an opposite side view of FIG. 1.

Referring to FIGS. 1 to 7 of the drawings a load handling vehicle of the telescopic lift truck type is indicated generally at 10. The vehicle 10 has a front end 11 and a rear end 12. Disposed in a front end region are a pair of front ground engageable wheels 13 which are spaced apart width-wise of the vehicle so as to be disposed one at each side 14, 15 of the vehicle. In a rear end region of the vehicle are provided a pair of rear ground engageable wheels 16 again disposed width-wise of the vehicle so that the wheels are disposed one at each side, 14, 15 of the vehicle.

An operator's seat 17 is disposed within an operator's compartment 18 in which is disposed a steering wheel 19 and a conventional foot and hand controls of the vehicle.

The operator's compartment 18 is provided with a top 18*a* having a plurality of openings 18*b* which may be glazed as desired. Of course the pattern of openings and whether or not they are glazed may be modified as necessary. The operator's compartment 18 is provided so as to be of adequate strength to satisfy necessary safety requirements in conventional manner.

Disposed beneath the operator's seat 17 is an engine 20 connected in conventional manner to a variable angle swash plate pump 21 which provides fluid via suitable conduits to motors 22 drivingly connected to the front wheels 13 which are mounted on the vehicle in conventional manner and which are not steerable. The hydraulic fluid is transmitted, in conventional manner to the motors 22 from a manually operable speed control, see FIG. 8, utilising the hydraulic sub-circuit indicated generally at VI in FIG. 8 in conventional manner.

Figure 5:
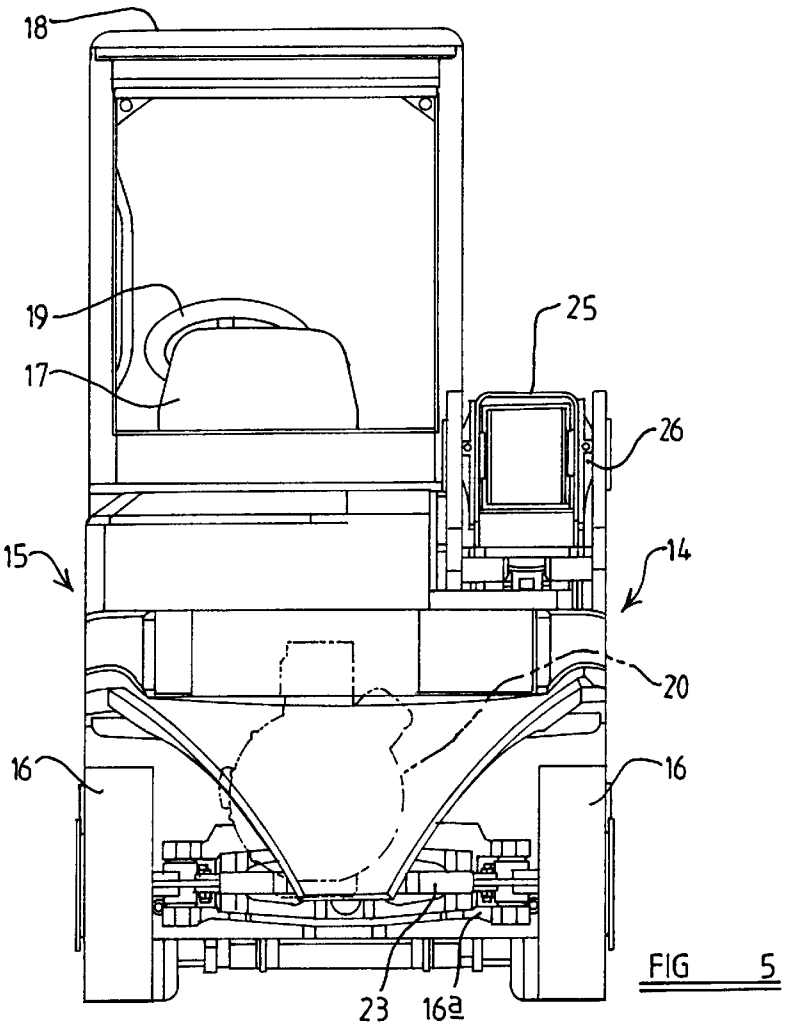
FIG. 5 is a rear view of the vehicle of FIG. 1.
Figure 4:
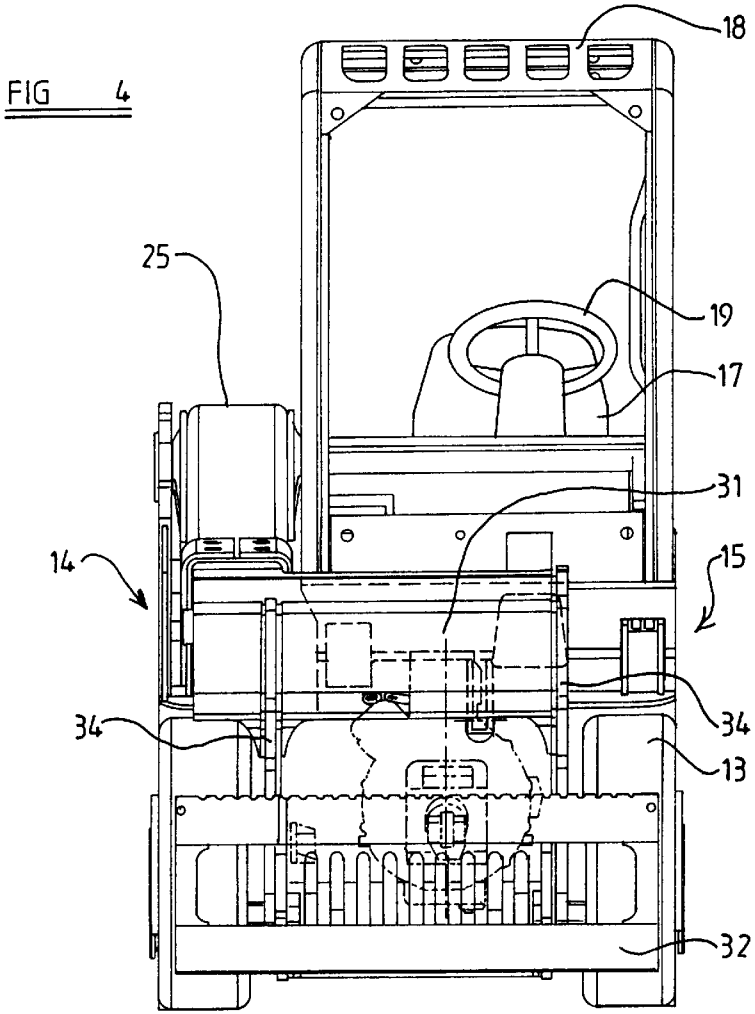
FIG. 4 is a front view of the vehicle of FIG. 1.
Figure 8:
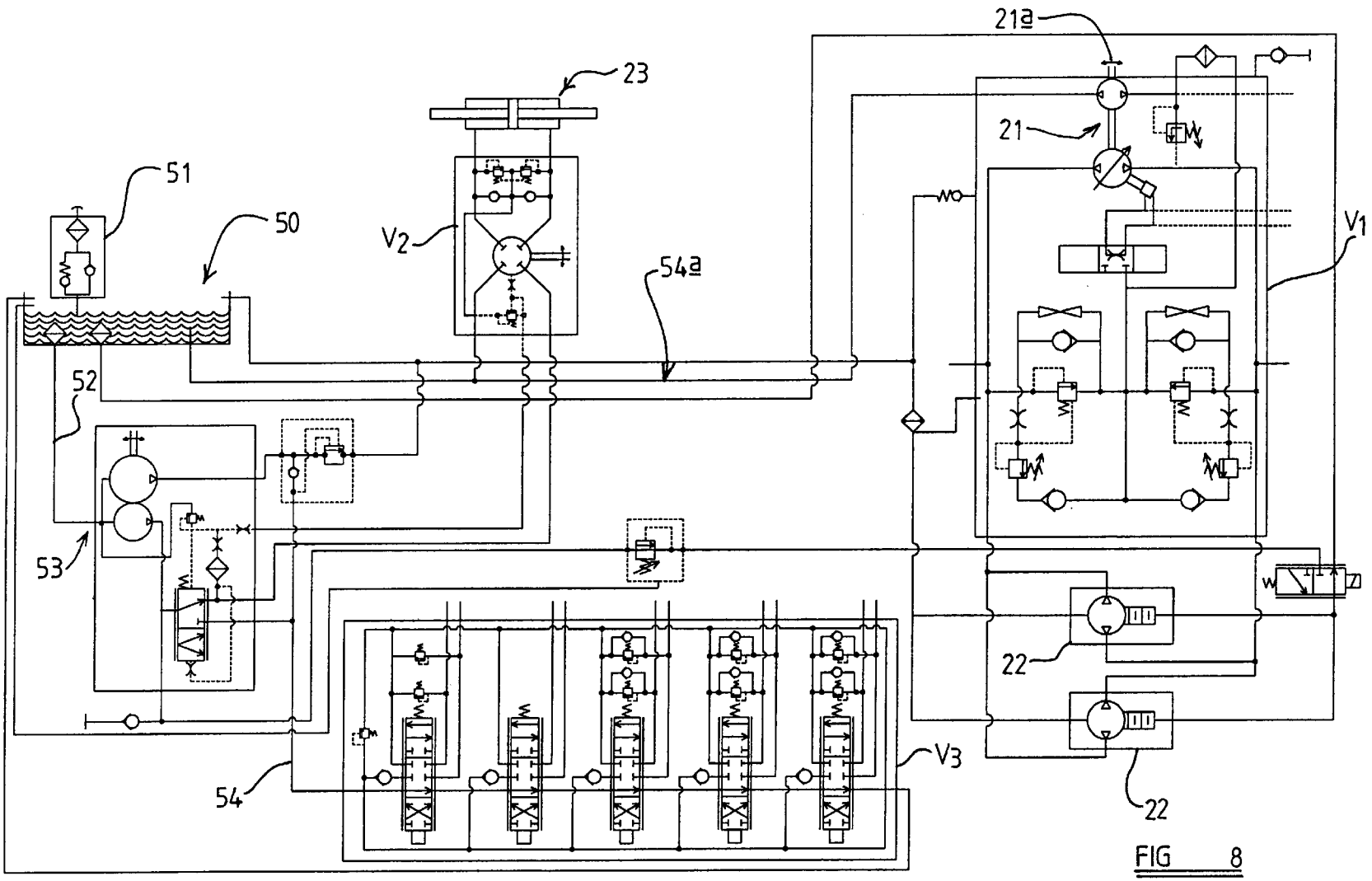
FIG. 8 is a partial circuit diagram of the hydraulic circuit of the vehicle of FIGS. 1 to 7.
Figure 9:
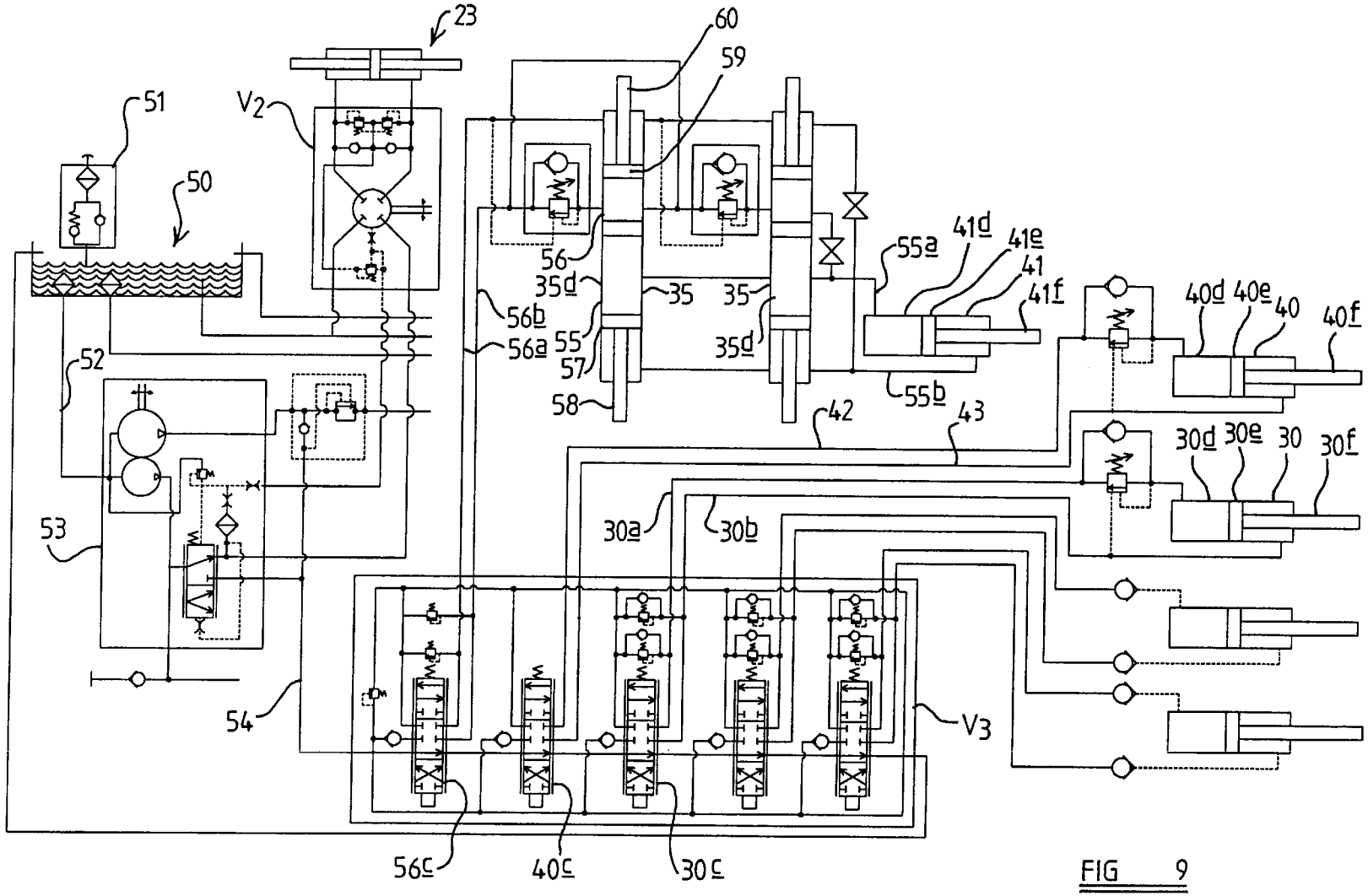
FIG. 9 is a further partial circuit diagram of the vehicle of FIGS. 1 to 7.
Figure 10:
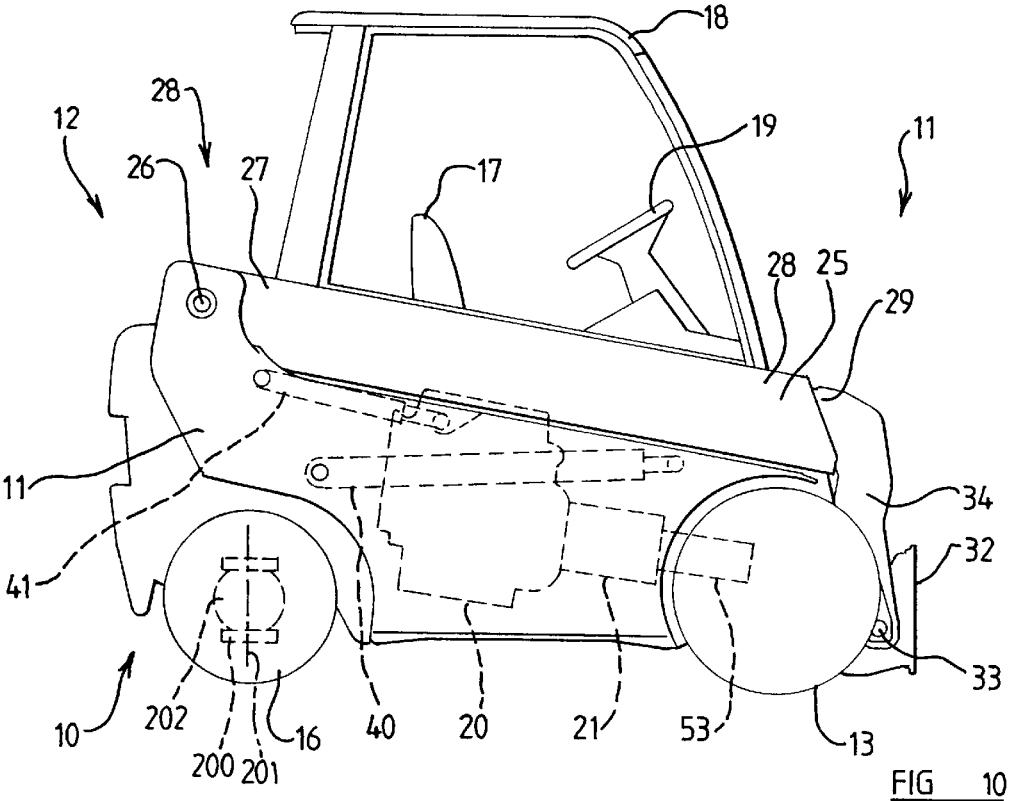
FIG. 10 is a side view of a modified load handling vehicle embodying the invention.
Figure 11:
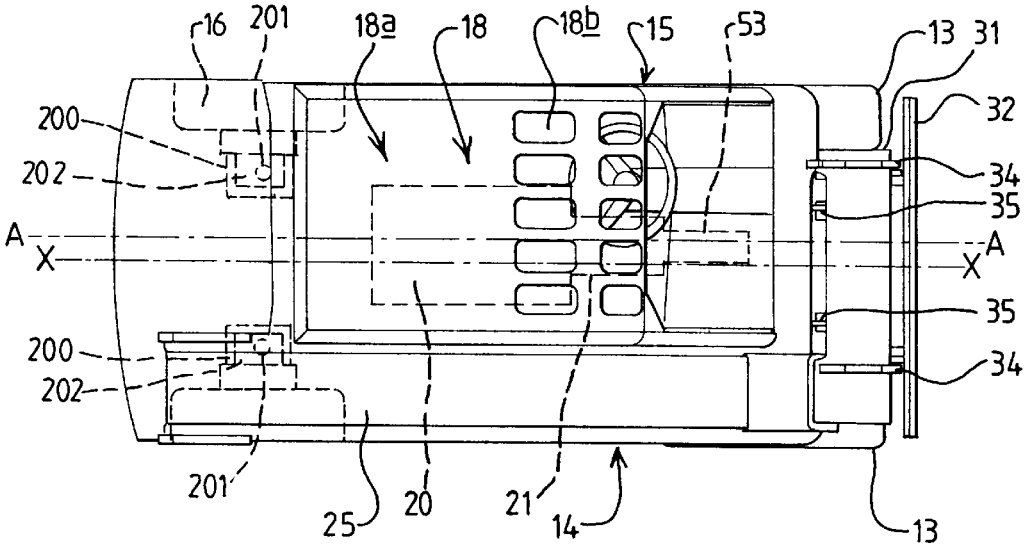
FIG. 11 is a plan view of the vehicle of FIG. 10.
Figure 12:
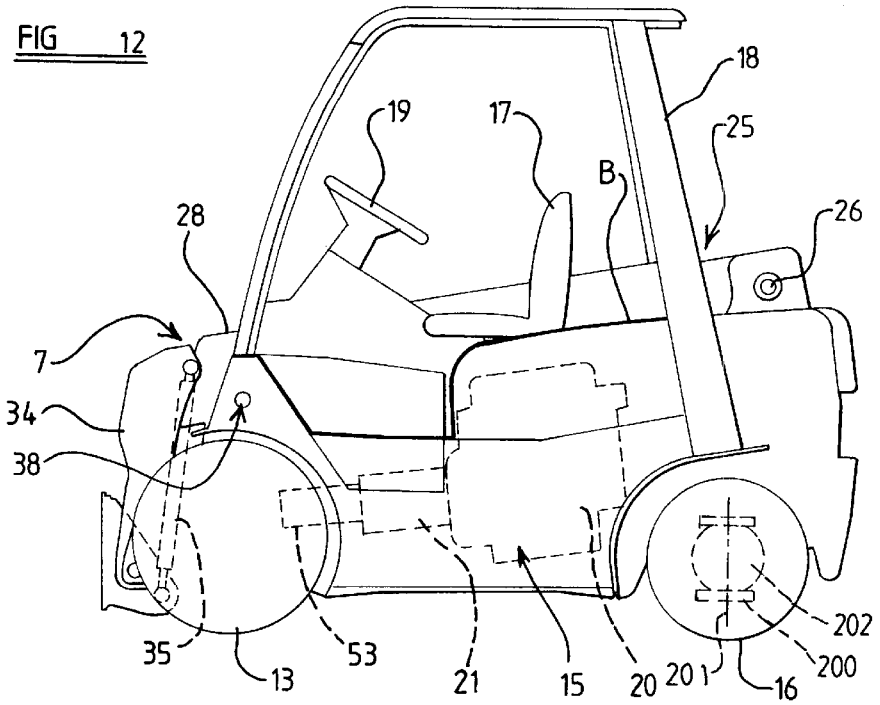
FIG. 12 is an opposite side view of FIG. 10.
Figure 13:
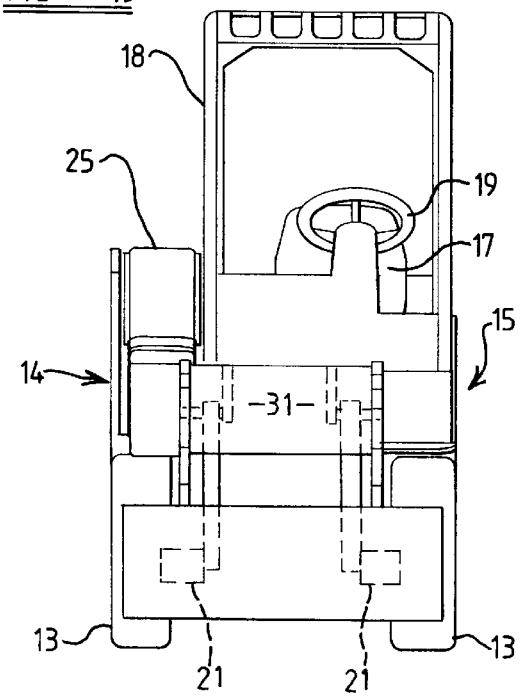
FIG. 13 is a front view of the vehicle of FIG. 10.

The rear wheels 16 are mounted by conventional suspension means 16*a* and are undriven but are steerable by means of steering ram 23, see FIGS. 5,8 and 9. The steering ram 23 is supplied with fluid by a steering valve indicated generally at V2 in FIGS. 8 and 9.

The front and rear wheels together with the motors 22 which drive the front wheels only comprise a ground engagable propulsion means of the vehicle.

The vehicle is provided with a single telescopic boom 25 which extends in a forward direction of the truck parallel to and off-set width-wise from, a central plane X—X of the vehicle. The boom 25 is mounted on the structure for up and down swinging movement by a pivot means 26 disposed in a rear end region 27 of the boom and also disposed in a rear end region 28 of the vehicle. The pivot means 26 is disposed rearwardly of the axis of rotation of the rear wheels 16 but longitudinally within their circumference so that in a present example a vertical line through the axis of pivot means 26 lies at a position which is about 30% of the diameter of the rear wheels 16 rearwardly of their axis of rotation. The overall boom length is 95% of the total machine length.

The boom 25 is off-set from the central plane X—X so as generally to overlie the front and rear wheels 13, 16 at one side 14 of the vehicle and to provide a space for the operator's compartment 18 between the boom 25 and the opposite side 15 of the vehicle.

The engine 20 is positioned so as to be offset from the centre line X—X of the vehicle, by approximately 100 mm in the illustrated example, in a direction away from a boom 25, thereby allowing the space below the boom to be unobstructed by the engine.

Thus, if desired, the boom, when lowered, may be at least partly alongside part of the engine. That is to say, a lower part of the boom and/or a component connected to the boom and depending downwardly therefrom may be below an upper part of the engine The boom 25 comprises a rearward portion 29*a* and a forward portion 29*b* telescopically received within the rearward portion 29*a* in conventional manner. An extension ram is provided between the boom parts 29*a* and 29*b* within the boom part 29*a* and is indicated generally in FIG. 9 at 30.

The forward boom portion 29*b* is provided with a width wise extending portion 31 which extends from the boom portion 29*b* towards the opposite side 15 of the vehicle and which carries an implement carrying means 32. The implement carrying means 32 may be provided with any desired load handling implement such as a pair of forks or a platform or any other desired load handling implement.

The implement carrying means 32 is connected to the transversely extending part 31 by a pair of pivot means 33 for pivotable crowd movement about a generally horizontal axis. The pivot means 33 are each carried on a limb 34 which extends downwardly from the transversely extending member 31.

The implement carrying means 32 is connected to the limbs 34 for pivotal movement under the control of a crowd ram means comprising a pair of crowd rams 35 which are pivotally connected to the implement carrying means 32 at 32*a* and to the transversely extending member 31 at 31*a*. The arrangement of the hydraulic circuit of the crowd rams 35 will be described hereinafter.

The boom 25 is caused to swing up and down by a lift ram 40 connected at 40*b*, to a lug of the boom part 29*a* and at 40*a* to the structure 11 to extend operatively therebetween.

A compensation ram 41 is also pivotally connected at 41*b*, to a lug of the boom part 29*a* and 41*a* to the structure 11 to extend operatively therebetween.

The cab maybe arranged to pivot forwardly relative to the remainder of the structure about an axis provided by a pivot means 38 so that the operator's compartment may be tilted upwardly and forwardly along with the seat, steering column and controls in conventional manner along a "split-line" B to provide access to the engine 20 and pump 21.

The operator's compartment 18 may be glazed on one or more sides. If glazed on all sides it is provided with an access door, not shown.

Figure 6:
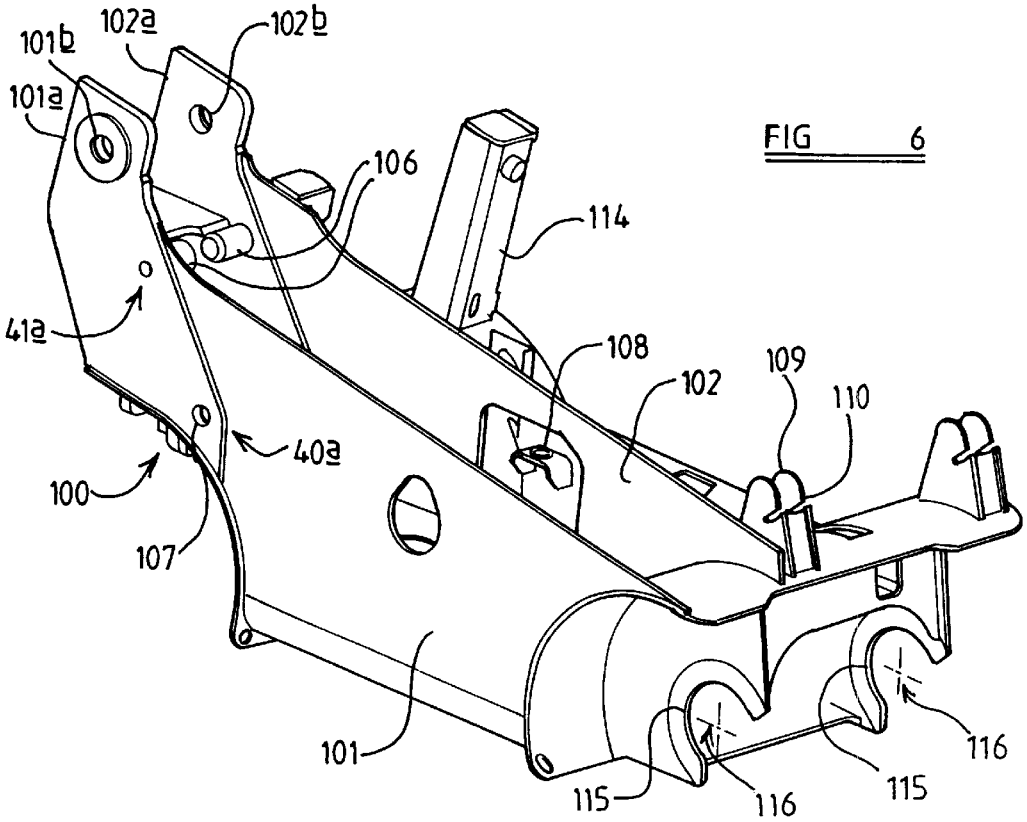
FIG. 6 is a fragmentary perspective view, from one side, of a chassis of the vehicle of FIG. 1.
Figure 7:
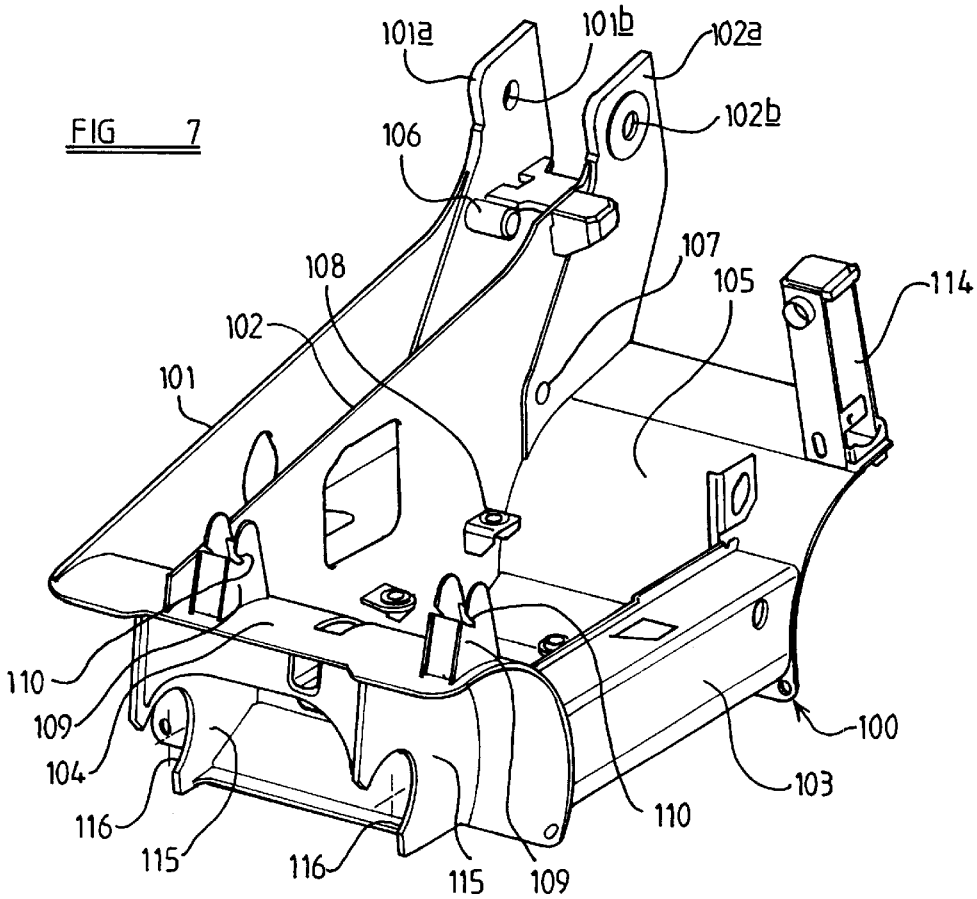
FIG. 7 is another fragmentary perspective view from the other side of the chassis of FIG. 6.

Referring now to FIGS. 6 and 7 the vehicle has a chassis 100 made as a welded fabrication. The chassis 100 comprises a pair of generally planar side frame members 101, 102 disposed on one side of the vehicle and a box section side frame member 103 disposed on the opposite side of the vehicle. The frame members 101, 102 and 103 are connected together by transversely extending front and rear portions 104, 105 of the chassis which are of curved configuration and essentially provide wheel arches for the front and rear wheels 13, 16 of the vehicle. The side frame members 101, 102 have, at their end, a upwardly extending part 101*a*, 102*a* respectively provided with an aperture 101*b*, 102*b* for the pivot means 26.

The frame members 101, 102 also have stub members 106 whereby the compensation ram 41 is connected to the structure 11 at the position 41*a*.

The side frame members 101, 102 are also provided with a lift ram pivot means 107 whereby the lift ram 40 is connected to the structure at the position 40*a*.

Four vibration/damping absorbing mounts 108 are provided on the inner frame member 102 and the opposite side frame member 103 for mounting the engine/pump assembly 20, 21 thereon.

The front transverse member 104 is provided with a pair of upstanding brackets 109 which provide a pair of slots 110 for the pivot means 38.

The chassis 100 is also provided with an upright 114, on said other side of the chassis, to provides a location for the operator's compartment 18

In addition, the chassis at the front end, is provided with a pair of forwardly projecting parts 115, provided with part circular apertures 116, which receive the front motors 22.

In the present example the ratio of the width of the operator's compartment to the overall width of the vehicle is 1:0.72 and the above mentioned ratio may lie, if desired, in the range 1:0.5 to 1:0.8.

In the present example the vehicle has an overall width of 1180 mm if desired, the width may be other than that specifically described with reference to the example and is generally less than 1200 mm.

The boom 25 is disposed so that when the boom is in a lowered position, as illustrated, an operator may see laterally as well as forwardly and rearwardly over the top of the boom and the load carrying implement. Even when the boom is being raised or lowered the operator view is relatively unobstructed as his vision is only obstructed when the implement and any load carrier thereon is in his line of sight. This is in contrast with a conventional fork lift truck in that the operator's view forwardly is not obstructed by any permanently present mast.

In the present example the axis of pivot 26 of the boom 25 is disposed at a position which is less than about 30% of the rear wheel diameter behind the axis of rotation of the rear wheel but may be positioned at any desired position within the range 0% to 50% of the rear wheel diameter being said axis of rotation of the rear wheels.

The axis of pivot 26 is, in the present example, positioned 55% of the overall vehicle height above ground on which the wheels of the vehicle are disposed but may be disposed in any desired position in the range 40% to 70%

Referring now to FIGS. 8 and 9, a reservoir for hydraulic fluid of the vehicle is indicated generally at 50 and is filled with fluid by filler/breather arrangement 51.

Fluid is fed from the reservoir 50 on line 52 to a engine driven pump arrangement indicated generally at 53 in conventional manner and fluid under pressure is supplied by the pump arrangement 53 to the steering valve arrangement V2 and, on line 54, to a boom control valve block V3. Fluid is supplied via line 54*a* to charge pump 21*a* which in turn supplies fluid under pressure to variable swash plate pump 21. Fluid under pressure is supplied to motors 22 its direction and flow being controlled by value means V1 which is controlled by the operator in conventional manner.

Appropriate returns are provided to the reservoir 50 from the valve means V1–V3.

Referring now particularly to FIG. 9, the extension ram 30 is connected by lines 30*a*, 30*b* to a extension control valve 30*c* within the valve block V3 so that manual operation of the valve 30*c* can supply fluid under pressure to the extension ram 30. The extension ram 30 comprises a cylinder 30*d* within which is a piston 30 connected to a rod 30*f*. The lift ram 40 is connected by lines 42, 43 to a manually operable valve 40*c* of the valve lock V3 so as to permit supply of fluid under pressure to the cylinder 40*d* on opposite sides of a piston 40*e* housed there within so as to cause extension or retraction of a piston rod 40*f* associated with the piston 40*e* and consequent to lifting or lowering swinging movement of the boom 25.

Each crowd ram 35 differs from rams provided for the lift ram and the extension ram by virtue of comprising a pair of separate cylinders 55, 56 which are hydraulically separate but are mechanically connected, in the present example, by being disposed coaxially end to end. The cylinder 55 houses a piston 57 connected by a piston rod 58 to the implement carrier 32. The cylinder 56 houses a piston 59 which is connected by a piston rod 60 to the associated limb 34. The cylinder 55 and its piston 57 comprise a first ram, and the cylinder 56 and piston 59 comprise a second ram hereinafter referred to as a tilt means.

The cylinders 56 are connected by lines 56*a*, 56*b* to a tilt valve 56*c* of the valve block V3 whilst the cylinders 55 are connected by lines 55*a*, 55*b* to opposite sides of a cylinder 41*d* of the compensation ram 41 in which is housed a piston 41*e* connected by a piston rod 41*f* to the boom 25 whilst the cylinder 41*d* is connected at the opposite end of the ram to the structure 11.

Accordingly, as the boom 25 is raised or lowered a corresponding pivotal movement of the implement carrier is caused to take place by the fluid displaced from the relevant side of the compensation ram 41 in to the cylinders 55.

When it is desired to perform crowd movement, the manually operable tilt valve 56*c* is operated to cause fluid to be fed to the relevant side of pistons 59 in the cylinders 56.

As a result, the tilting movement of the implement relative to the boom caused by the crowd ram means as a whole may comprise a component due to operation of the first rams to maintain the implement in a desired orientation relative to a horizontal plane or a component due to operation of the tilt means comprising the second rams for tilting movement of the implement relative to the boom under manual control or may comprise both components due to operation of both of the first and second rams. In short, the first and second rams are arranged so that the outputs of the two rams are connected "in series". Thus operation of either the first or the second rams causes tilting movement of the implement relative to the boom but operation of both rams causes a resultant movement of the implement relative to the boom which is effectively an algebraic sum of the component movements.

In accordance with the present invention the cylinders for compensation movement and tilting movement are independent and the respective cylinders may be of appropriate size to enable achievement of a desired pivotal movement for compensation and for tilting movement. In the present example the boom 25 may be swung up and down over an arc of about 70° whilst tilting movement may be provided over a range of −5° from the horizontal to +12° from the horizontal.

If desired, the mechanical configuration of the crowd rams 35 may be provided as desired. For example, instead of providing a pair of cylinders disposed end to end in co-axial relationship each crowd ram 35 may comprise two separate cylinders facing in opposite directions but arranged, for example, side-by-side or in any other suitable configuration in which the tilt and compensation cylinders are arranged to operate independently.

Figure 20:
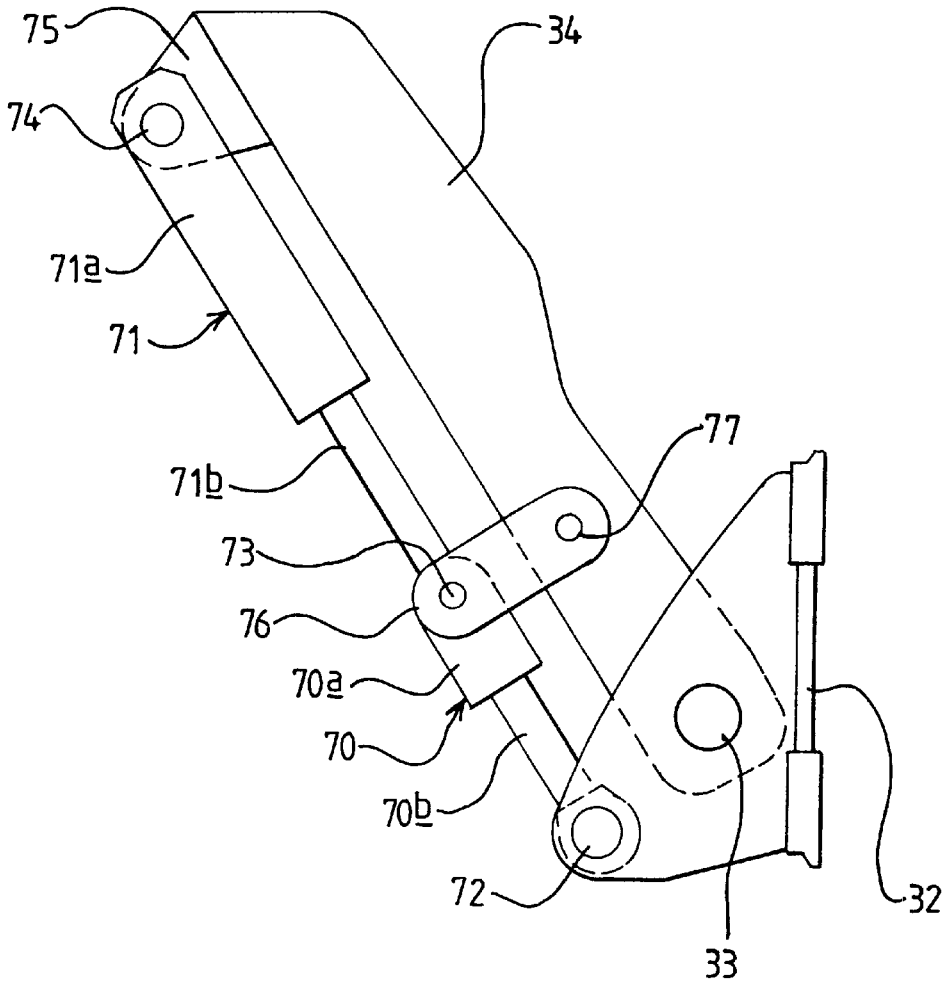
FIG. 20 is a side view of an alternative embodiment of the crowd ram means.

An alternative mechanical configuration of the crowd ram means is shown in FIG. 20, wherein the same reference numerals have been used to refer to corresponding parts of the crowd ram means as shown in the embodiments of the vehicle as described with reference to FIGS. to 1 to 19. The implement carrying means 32 is connected to the limbs 34 for pivotal movement about pivot means 33, and is controlled for pivotal movement by a first ram 71, comprising a single double-acting ram and a second ram 70 comprising a single double acting ram providing a tilt means. The second ram 70 comprises a cylinder 70*a* housing a piston (not shown) connected by a piston rod 70*b* to the implement carrying means 32 via a pivot 72. The first ram 71 similarly comprises a cylinder 71*a* housing a piston (not shown) connected by a piston rod 71*b* to the second ram 70 by pivot 73. The first ram 71 is connected at its other end to the limb 34 by pivot means 74 provided on an ear 75 of limb 34. To constrain movement of the first and second rams, a link 76 is pivotally attached to cylinder 70*a* and rod 71*b* by pivot 73 and is pivotally attached to limb 34 by pivot 77. The first ram 71 is connected in fluid circuit with a compensation ram (not shown) as described in the embodiments described hereinbefore, to maintain the load handling implement in a constant orientation, relative to a horizontal plane as the boom is raised or lowered. The second ram is connected in fluid circuit with an operator control (not shown) as described in the foregoing embodiments, for supply of fluid thereto to cause tilting movement of the implement relative to the boom under operator control.

The rams for compensation movement and tilting movement are thus independent, and may be operated by a suitably modified hydraulic circuit of the kind shown in FIG. 9. The respective rams may be of an appropriate size to enable achievement of a desired pivotal movement for compensation and tilting movement as before.

FIGS. 10 to 14 show a modification of the vehicle described hereinbefore with reference to FIGS. 1 to 9. In these figures the arrangement of the vehicle is illustrated diagrammatically as details of the vehicle are the same as described in connection with FIGS. 1 to 9 except as hereinafter to be stated and the same reference numerals have been used to refer to corresponding parts.

Figure 14:
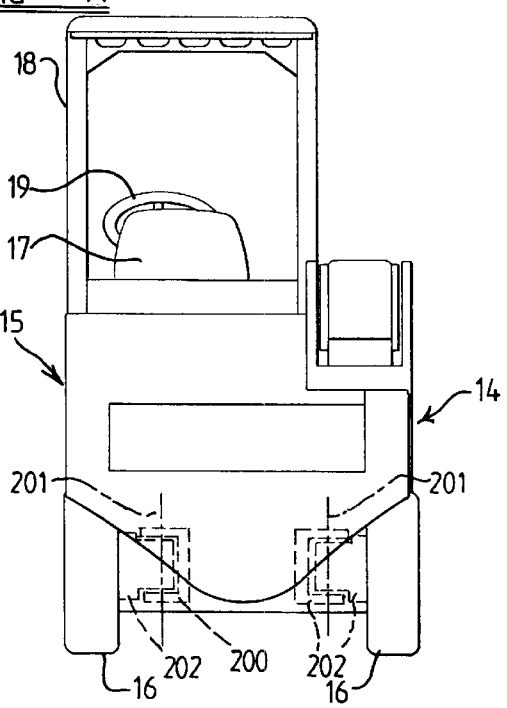
FIG. 14 is a rear view of the vehicle of FIG. 10.
Figure 15:
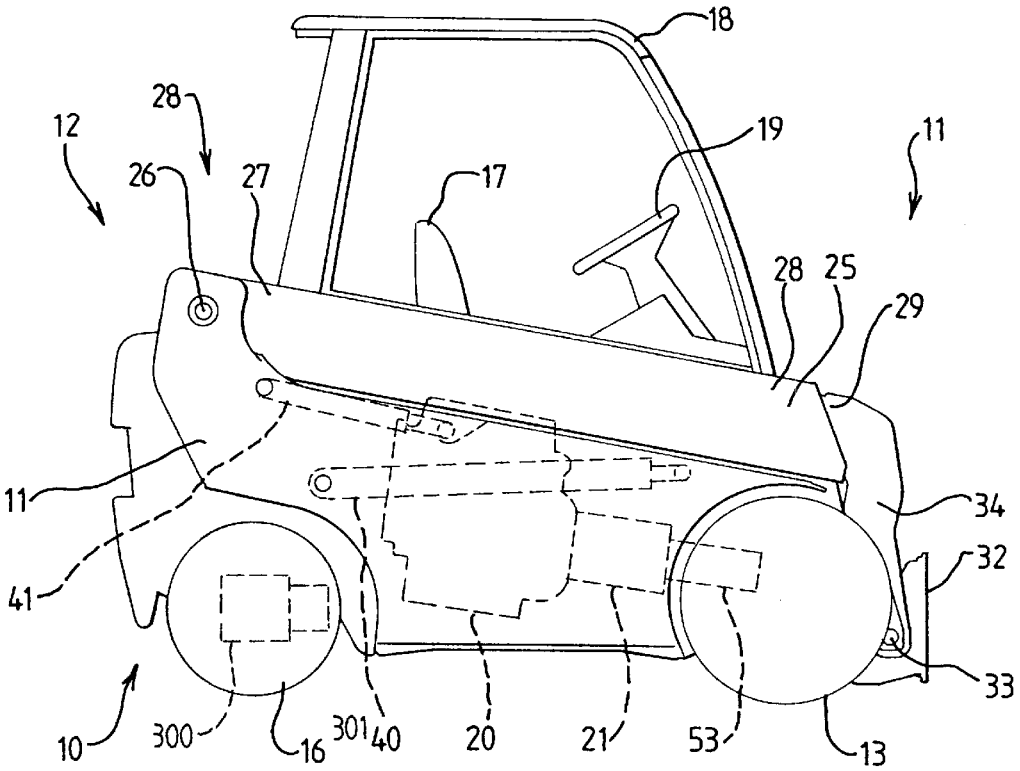
FIG. 15 is a side view of another modified load handling vehicle embodying the invention.
Figure 16:
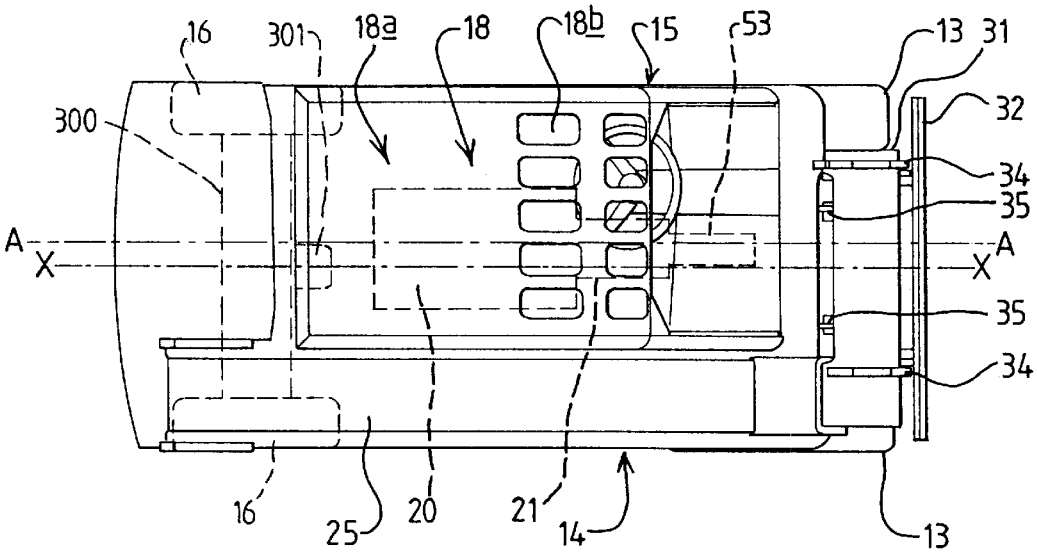
FIG. 16 is a plan view of the vehicle of FIG. 15.
Figure 17:
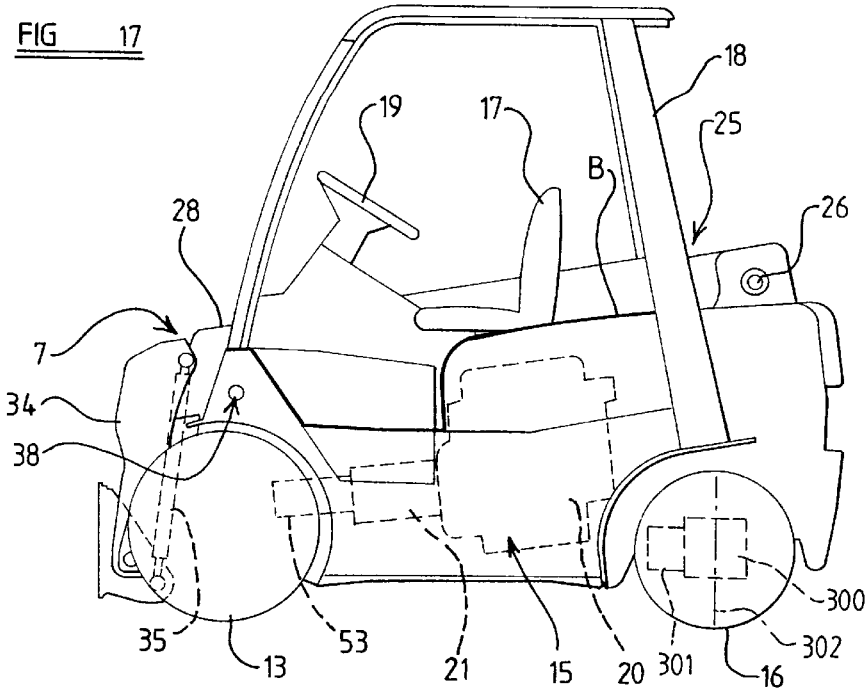
FIG. 17 is an opposite side view of FIG. 15.
Figure 18:
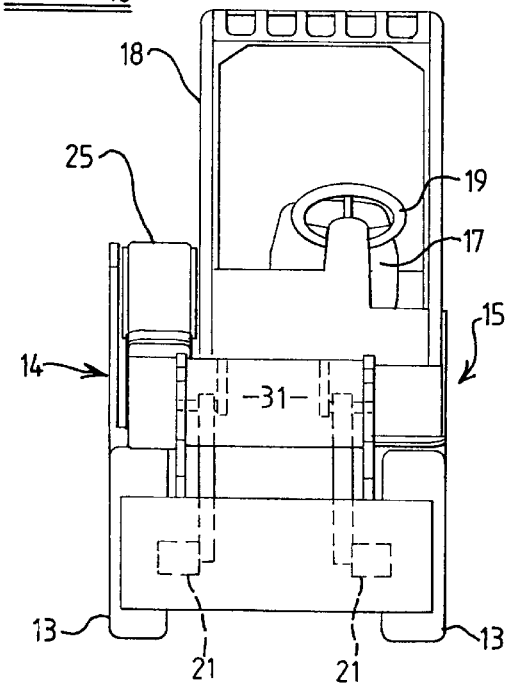
FIG. 18 is a front view of the vehicle of FIG. 15 and, FIG. 19 is a rear view of the vehicle of FIG. 15.
Figure 19:
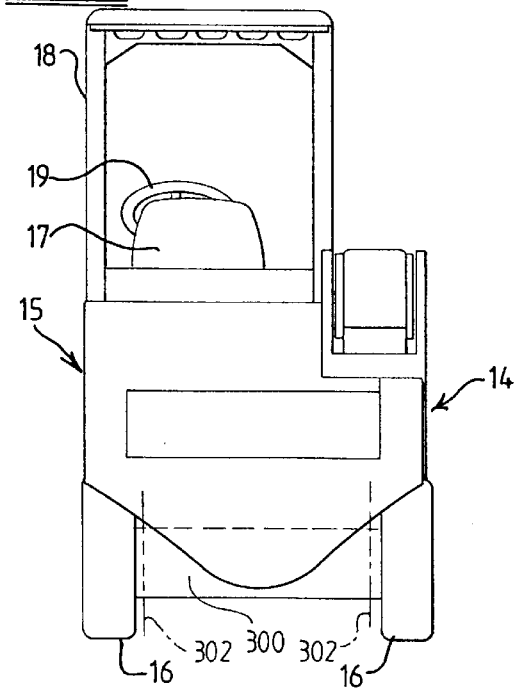

In this example the rear wheels 16 besides being steerable are also driven. As best shown in FIG. 14, rear wheels 16 are carried on bracket members 200, fixed to the chassis 100, for rotation about a vertical axis 201 and each wheel 16 is driven by a hydro-static motor 202 which is pivotable with the wheel. The hydro-static motors 202 are driven from the pump 21 by flexible conduit means in conventional manner.

Referring now to FIGS. 15 to 19, again the vehicle is as described hereinbefore with reference to FIGS. 1 to 9 and as in the first mentioned modification the rear wheels 16 are steerable and driveable. In this example the rear wheels 16 are carried on opposite ends of an axle assembly 300 which is provided with a hydro-static motor 301 which drives the wheels 16 through an appropriate differential drive mechanism within the axle 300. The hydro-static motor 301 is driven from the pump 21 in conventional manner and the wheels 16 are mounted on the axle 300 so as to be rotatable about upright steering axis 302.

Figure 21:
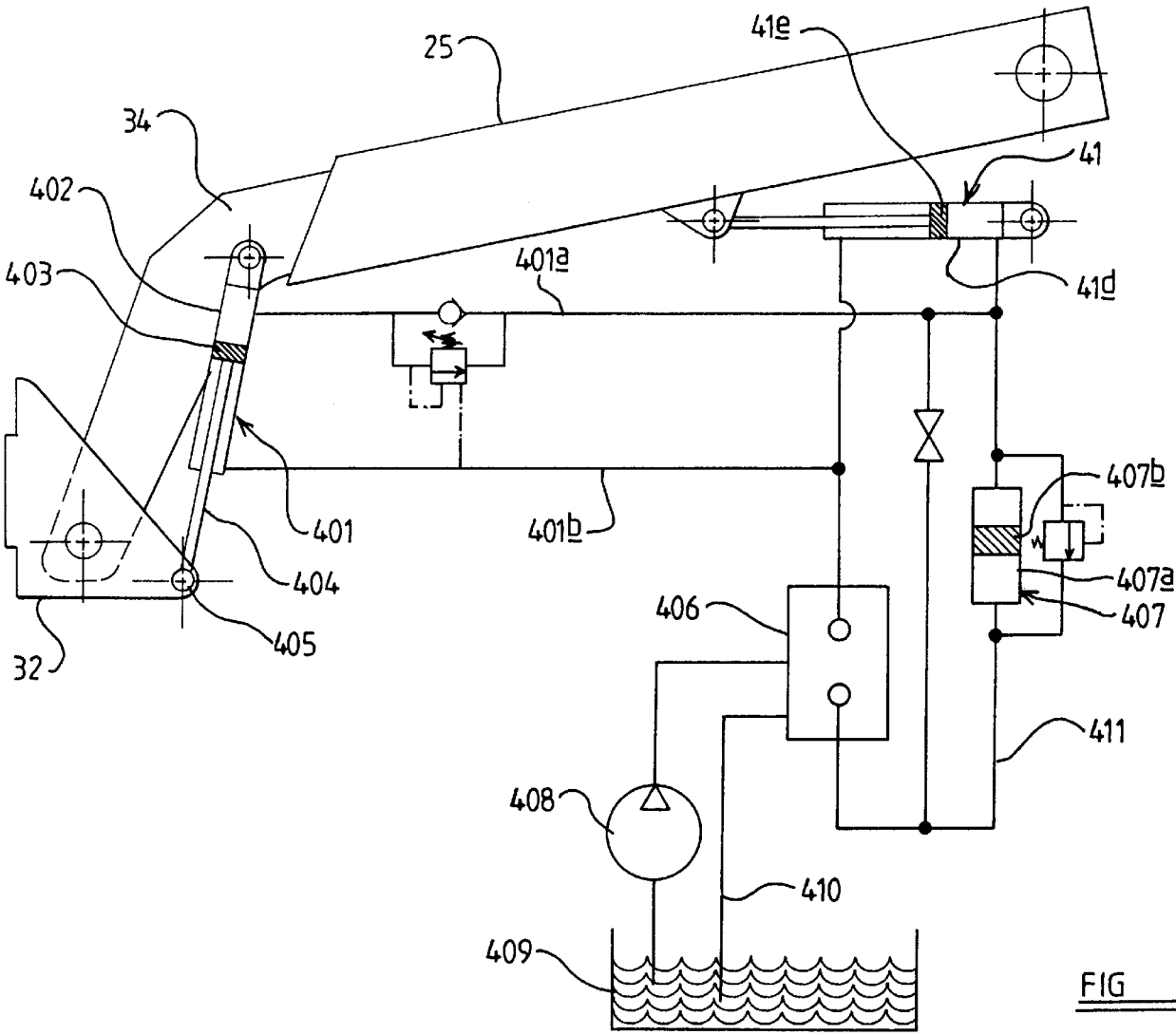
FIG. 21 is a schematic view and partial circuit diagram of a boom arm according to a further embodiment of the invention.

Referring now to FIG. 21, an alternative embodiment of the crowd ram means is shown. The crowd ram means may be applied to a vehicle as described hereinbefore with reference to FIGS. 1 to 19, the same reference numerals referring to corresponding parts. As before, the vehicle comprises a single telescopic boom 25 to which is attached a compensation ram 41. A first ram 401 is provided comprising a double acting ram, attached to the implement carrying means 32 and the limb 34. Said first ram 401 comprises a cylinder 402 housing a piston 403 connected by a piston rod 404 to the implement carrier 32 by a pivot 405. The cylinder 402 is connected at opposite sides of the piston 403 to each side of a piston 41*e* housed within a cylinder 41*d* of the compensation ram 41. The cylinder is further connected by line 401*b* to a control valve 406 of the type shown at FIG. 56*c* in FIGS. 8 and 9. A tilt means is provided comprising a dosing pot 407, the dosing pot 407 comprising a cylinder 407*a* housing a piston 407*b*. The cylinder 402 is connected on line 401*a* to one side of the dosing pot 407, the other side of said dosing pot 407 being connected by line 411 to the control valve 406. Pressurised fluid is supplied to the control valve 406 by a pump 408 drawing fluid from a reservoir 409 while a return line 410 leads from the control valve 406 to the reservoir 409. It will be clear that such an arrangement could be included in a circuit of the type shown in FIGS. 8 and 9.

As before, when the boom 25 is raised or lowered, a corresponding pivotal movement of the implement carrier 32 is caused to take place by the fluid displaced from the relevant side of the compensation ram 41 into the cylinder 402.

To cause downward pivoting of the implement carrier 32 under operator control the control valve 406 is moved to a first position wherein line 401*b* is connected to the pump 408 and line 411 is connected to the return line 410 to the reservoir 409. As viewed in FIG. 21, fluid pressure is supplied to the lower side of the piston 403, forcing it to move upwardly, and so tilting the implement carrier 32 downwards. The pressure is thus increased on line 401*a* which acts upon the piston 407*b* of the dosing pot 407, causing it to move downwardly. Conversely, when it is desired to tilt the implement carrier 32 upwards, the control valve is moved to a second position wherein line 411 is connected to the pump 408 and line 401*b* is connected to line 410. Fluid pressure is supplied to the lower side of the dosing pot piston 407*b* which is forced upwards, increasing the pressure in line 401*a* and hence in the upper part of the cylinder 402, forcing the piston 403 and ram 404 downwards and tilting the implement carrier 32 downwards.

The maximum range of movement of the piston 403 in response to operation of the control valve 406 is constrained by the range of movement of the dosing pot piston 407*b* in the cylinder 407*a*. When the control valve 406 is operated to supply fluid to the first ram 401 to tilt the implement carrier 32 downwards, a corresponding volume of fluid is displaced by the first ram 401 which accordingly forces the 407*b* of the dosing pot 407 to move downwardly. If further fluid is supplied to the first ram 401, eventually the piston 407*b* will reach the lower end of the dosing pot cylinder 407*a* as shown in FIG. 21 and will be unable to move any further. No more fluid can be displaced from the ram 401 on line 401*a* and hence the piston 403 and piston rod 404 can move no further, and the implement carrier 32 has reached the limit of the range of downwards tilting movement which can be effected by the operator. Conversely, when it is desired to tilt the implement carrier 32 upwardly and fluid is supplied to the lower side of the dosing pot piston 407*b,* once the piston 407 has reached the upper limit of its range of movement in the dosing pot cylinder 407*a,* no further fluid can be displaced from the dosing pot cylinder 407*b* to the first ram 401, and hence the implement carrier 32 is at the limit of its range of upward tilting movement which can be effected by the operator.

The supply of fluid to the first ram 401 of course has no actuating effect on the compensation ram 41 but merely serves to alter the inclination of the material handling implement 32. In the event of the boom being operated, the compensation ram 41 will cause movement of the piston 403 of the first ram 401 as described in the foregoing embodiments. This embodiment removes the need for a second, separate ram as used in the foregoing embodiments.

The ground engageable propulsion means in all embodiments comprises a pair of front and a pair of rear ground engageable wheels and a drive motor to drive at least one of said pairs of wheels.

Besides the drive arrangements described hereinbefore, if desired, the drive motor may drive only the rear, steerable, wheels. As a generality, if desired, the front wheels may be steerable as well as or instead of, the rear wheels and the front wheels and/or the rear wheels may be driven by suitable adaption of the suspension, steering and drive means described hereinbefore. Further, although hydrostatic drive means have been described hereinbefore, if desired, in any version the drive means may be provided wholly or partly by a mechanical transmission from the engine to the wheels.

If desired the vehicle described hereinbefore may be provided without the crowd ram facility described hereinbefore with reference to FIGS. 8, 9, 20 or 21 or, alternatively, the crowd ram facility described with reference to FIGS. 8, 9, 20 or 21 may be provided in a vehicle of different configuration to that described hereinbefore with reference to the other figures.

What is claimed is:

1. A material handling vehicle capable of entry into confined height and width building entrances for such vehicles and of operating within space restricted locations, said material handling vehicle comprising:

a structure having a load carrying means at one end of the vehicle, power means to raise the load carrying means, ground engageable propulsion means comprising a pair of front ground engageable wheels disposed one at each side of the vehicle and a pair of rear ground engageable wheels disposed one at each side of the vehicle, an operator's seat and an engine to provide power for said propulsion means to drive at least one of said pairs of wheels and for said power means to raise load carrying means, in which the load carrying means comprises a telescopic boom with a boom pivot mounted to the structure in close rearward proximity to the seat at a rear region of the boom for up and down swinging movement by said power means in a plane extending forwardly and rearwardly of the vehicle and the boom having a load carrying implement at a forward region thereof, the front ground engageable wheels are driven by said engine and the rear ground engageable wheels are steerable, and a region, disposed generally beneath the seat in which the engine is disposed, the boom being offset from the centre line of the vehicle substantially to overlie the front and rear wheels at one side of the vehicle the axis of rotation of the crankshaft of the engine extending in a direction generally longitudinal of the vehicle and generally parallel to the boom and being offset away from the centre line of the vehicle in a direction which is away from the boom enabling the boom to be unobstructed by the engine when overlying the front and rear wheels at one side of the vehicle, and wherein a vertically extending plane containing the centre line of the vehicle intersects the engine.

2. A vehicle according to claim 1 wherein the rear ground engageable wheels are undriven by said motor.

3. A vehicle according to claim 1 wherein, when lowered, the boom is partly alongside the engine.

4. A vehicle according to claim 1 wherein, when the boom is lowered a component depending downwardly from the boom is partly alongside the engine.

5. A vehicle according to claim 1 wherein the boom provides clearance width-wise of the vehicle for the driver's seat to be disposed alongside the boom.

6. A vehicle according to claim 1 wherein the vehicle has an overall width of less than 1.2 meters.

7. A vehicle according to claim 1 wherein the operator's seat is positioned within an operator's compartment.

8. A vehicle according to claim 6 wherein the ratio of the width of the operator's compartment to the overall width of the vehicle lies in the range 0:0.5 to 1:0.8.

9. A vehicle according to claim 1 wherein the engine is drivingly connected to the front wheels by hydrostatic drive means.

10. A vehicle according to claim 1 wherein the engine is drivingly connected to the rear wheels by hydro-static drive means.

11. A vehicle according to claim 1 wherein the load carrying implement is offset widthwise of the vehicle from the boom so that the load carrying implement is disposed in a region which is disposed substantially centrally of the vehicle in a widthwise direction.

12. A vehicle according to claim 6 wherein the operator's compartment, including the seat, is pivotally mounted relative to the structure about an axis extending width wise of the vehicle at a position disposed at the front of the compartment so that the compartment and seat may be pivoted upwardly and forwardly to provide access to the engine.

13. A vehicle according to claim 1 wherein the axis of pivot of the boom is disposed at a position which is less than 30% of the rear wheel diameter behind the axis of rotation of the rear wheel.

14. A vehicle according to claim 1 wherein the overall boom length is 95% of the total machine length.

15. A vehicle according to claim 1, wherein the vehicle width is substantially defined by the cab and boom side-by-side, and the engine being substantially lower than the boom to provide a lowered vehicle height and a narrow vehicle width.

16. A vehicle according to claim 1, including hydrostatic drive means and a hydrostatic pump, said hydrostatic pump being coupled to said engine and drivingly coupled by said hydrostatic drive means to at least one of said pairs of front and rear ground engageable wheels, said hydrostatic pump being disposed forwardly in front of the engine.

17. A material handling vehicle capable of entry into confined height and width building entrances and for operating in length and width restricted locations, the material handling vehicle comprising:

a chassis structure defining a vehicle longitudinal axis;

a pair of front ground engageable wheels and a pair of rear ground engageable wheels carried by the chassis structure;

an operator's seat positioned on one side of the vehicle longitudinal axis;

an engine for driving one or more of the ground engageable wheels, the engine positioned within a region disposed generally beneath the seat;

a telescopic boom mounted to the chassis structure at a boom pivot in close rearward proximity to the seat at a rear region of the boom for up and down swinging movement in a plane extending forwardly and rearwardly of the vehicle, the boom being laterally offset from the vehicle longitudinal axis to substantially overlie one front and one rear wheel at one side of the chassis structure; and wherein the axis of rotation of a crank shaft of the engine extends in a direction generally longitudinal of the vehicle and generally parallel to the boom and being offset away from the vehicle longitudinal axis in a direction which is away from the boom, enabling the boom to be unobstructed by the engine when overlying the front and rear wheels at the one side of the vehicle chassis structure.

* * * * *